US007438464B2

(12) United States Patent
Moser et al.

(10) Patent No.: US 7,438,464 B2
(45) Date of Patent: Oct. 21, 2008

(54) STATIC MIXER WITH POLYMORPHIC STRUCTURE

(75) Inventors: Felix Moser, Neftenbach (CH); Gerhard Sebastian Hirschberg, Winterthur (CH); Markus Fleischli, Winterthur (CH)

(73) Assignee: Sulzar Chemtech AG, Winterthur (CH)

( * ) Notice: Subject to any disclaimer, the term of this patent is extended or adjusted under 35 U.S.C. 154(b) by 446 days.

(21) Appl. No.: 10/903,273

(22) Filed: Jul. 30, 2004

(65) Prior Publication Data

US 2005/0047274 A1 Mar. 3, 2005

(30) Foreign Application Priority Data

Aug. 26, 2003 (EP) ..... 03405617.6

(51) Int. Cl.
*B01F 5/00* (2006.01)

(52) U.S. Cl. ..... 366/336; 366/337

(58) Field of Classification Search ..... 366/336, 366/337, 338, 339
See application file for complete search history.

(56) References Cited

U.S. PATENT DOCUMENTS

| | | | | |
|---|---|---|---|---|
| 3,195,865 | A * | 7/1965 | Harder | 366/337 |
| 3,239,197 | A * | 3/1966 | Tollar | 366/337 |
| 4,758,098 | A * | 7/1988 | Meyer | 366/337 |
| 5,484,203 | A * | 1/1996 | King et al. | 366/337 |
| 5,564,827 | A | 10/1996 | Signer | |
| 5,605,399 | A * | 2/1997 | King | 366/337 |
| 5,620,252 | A * | 4/1997 | Maurer | 366/337 |
| 5,851,067 | A * | 12/1998 | Fleischli et al. | 366/337 |
| 5,961,908 | A * | 10/1999 | Reinehr et al. | 264/169 |
| 6,027,241 | A * | 2/2000 | King | 366/181.5 |
| 6,102,561 | A * | 8/2000 | King | 366/181.5 |
| 6,135,629 | A * | 10/2000 | Dohmann | 366/181.5 |
| 6,257,754 | B1 * | 7/2001 | Sondergaard | 366/174.1 |
| 6,394,644 | B1 * | 5/2002 | Streiff | 366/337 |
| 6,419,386 | B1 * | 7/2002 | Fleischli et al. | 366/336 |
| 6,599,008 | B2 * | 7/2003 | Heusser et al. | 366/337 |
| 6,604,850 | B1 * | 8/2003 | Schneider et al. | 366/175.2 |
| 6,615,507 | B2 * | 9/2003 | Ruscheweyh et al. | 34/181 |
| 6,773,156 | B2 * | 8/2004 | Henning | 366/337 |
| 7,325,970 | B2 * | 2/2008 | Keller | 366/337 |
| 2001/0003291 | A1 * | 6/2001 | Uematsu et al. | 137/888 |
| 2001/0015936 | A1 * | 8/2001 | Heusser et al. | 366/337 |
| 2003/0007419 | A1 * | 1/2003 | Goebel et al. | 366/336 |
| 2003/0048694 | A1 * | 3/2003 | Horner et al. | 366/337 |
| 2003/0179648 | A1 * | 9/2003 | Heusser et al. | 366/336 |

(Continued)

FOREIGN PATENT DOCUMENTS

| | | |
|---|---|---|
| EP | 0472491 | 2/1992 |

(Continued)

*Primary Examiner*—Tony G Soohoo
(74) *Attorney, Agent, or Firm*—Francis C. Hand; Carella, Byrne, Bain et al.

(57) ABSTRACT

The static mixer has a polymorphic structure that can be used for mixing or homogenizing a fluid medium. The mixer has at least two sections arranged in a tube one after the other in the longitudinal direction. Baffles of the first section that are effective to promote mixing redistribute the medium to be mixed largely globally over the entire cross-section of the tube. Baffles of the second section that are effective to promote mixing effect largely local mixing in partial regions, which in each case contain only one part of the tube cross-section. The baffles of both sections have the same or approximately equally large hydraulic diameters.

11 Claims, 2 Drawing Sheets

U.S. PATENT DOCUMENTS

| | | | | |
|---|---|---|---|---|
| 2004/0141413 | A1 * | 7/2004 | Keller | 366/337 |
| 2005/0047274 | A1 * | 3/2005 | Moser et al. | 366/336 |
| 2006/0245299 | A1 * | 11/2006 | Heusser et al. | 366/336 |
| 2007/0263485 | A1 * | 11/2007 | Yang et al. | 366/336 |

FOREIGN PATENT DOCUMENTS

| | | | |
|---|---|---|---|
| EP | 1312409 | A1 * | 5/2003 |
| WO | WO 99/00180 | A1 * | 1/1999 |

* cited by examiner

STATIC MIXER WITH POLYMORPHIC STRUCTURE

This invention relates to a static mixer with a polymorphic structure.

As is known a large variety of static mixers are known for mixing various types of materials, for example, to effect homogenization a material composed of different components or to mix together different materials to achieve a homogenous mixture. In many cases, the static mixers have been constructed with baffles that are oriented to promote a mixing action. In some cases, the mixers are composed of baffles that have the same shape. In this case, one can speak of static mixers with monomorphic structure. In other cases, mixers have been composed of baffles that have different structures. In this latter case, the mixers have a polymorphic structure.

A static mixer with a polymorphic structure which can be designated as a "multi-scale mixer" is disclosed in U.S. Pat. No. 5,605,399 (King). In this multiscale mixer, a plurality of sections are arranged one after the other, with the baffles of the sections having scalings of their structures which become progressively finer. That is, the structures have in each case a smaller hydraulic diameter from section to section.

The multi-scale mixer is particularly suitable for dispersion processes. The specific energy input, which increases in a progressive manner, causes for example increasingly smaller drops to arise.

For a purely distributive mixing which is carried out with mutually soluble components, the specific energy input need not be increased. In known mixers, layers develop in the medium which become ever finer when the hydraulic diameter remains constant, i.e. when the scaling remains constant.

The purpose of the static mixer is to homogenize a fluid medium with as low an energy expenditure as possible and obtain an ideal mixing quality for the product. In this context, achieving an ideal mixing quality can be understood as follows: By means of static baffles in a tube of predetermined length a homogeneity of the medium which is sufficient for the application should be produced with the use of a minimum mechanical power, i.e. with as small a pressure drop as possible along the baffles. (When samples of the homogenized fluid are taken, it should be possible to determine approximately equal concentrations at all points.)

In order to obtain an ideal mixing quality, it is basically a matter on the one hand of a redistribution of the medium to be mixed taking place over the entire tube cross-section and on the other hand of a thorough mixing also being obtained in small regions. Thus, both global and local mixing processes are decisive in a homogenization process.

Accordingly, it is an object of the invention to create a static mixer for a distributive mixing which, having regard to the prior art, represents an advance with respect to the desired mixing quality and with respect to the cost and complexity required to obtain this mixing quality.

It is another object of the invention to provide a static mixer that is able to obtain homogenization of a medium at a low energy expenditure.

Briefly, the invention provides a static mixer with a polymorphic structure that can be used for mixing or homogenizing a fluid medium and that is constructed of at least two sections arranged in a tube one after the other in the longitudinal direction. The first section is provided with baffles that are effective to promote mixing and that redistribute the medium to be mixed largely globally over the entire cross-section of the tube. The second section is provided with baffles that are effective to promote mixing and that effect largely local mixing in partial regions which, in each case, contain only a part of the tube cross-section. The baffles of both sections have the same or approximately equally large hydraulic diameters.

The mixer in accordance with the invention is a "polymorphic uniscale mixer". In differently structured sections of the uniscale mixer, the hydraulic diameters are in each case the same or approximately equally large, i.e. the partial structures are "scaled" equally.

In one embodiment, the static mixer comprises a tube for passage of a fluid medium to be mixed and at least two sections of baffles arranged in a first portion of the tube in sequential manner in a longitudinal direction of the tube. The baffles in the first section are effective to promote mixing and to redistribute the fluid medium largely globally over the entire cross-section of the tube. The baffles in the second section are effective to promote mixing and to effect largely local mixing in partial regions that contain only one part of the cross-section of the tube.

In another embodiment, the static mixer comprises a tube for passage of a fluid medium to be mixed and a plurality of mixer elements disposed longitudinally within said tube. Each mixer element has a first section defining layers of inclined flow passages oriented in the longitudinal direction to effect a transport of the medium between points within one half of the cross-section of the tube with the flow passages of neighboring layers disposed in crossing relation to each other and a second section defining layers of inclined flow passages oriented in the longitudinal direction to effect a transport of the medium between points within one half of the cross-section of the tube with the flow passages of neighboring layers disposed in crossing relation to each other. The layers of the second section are also displaced 90° about a longitudinal axis of the tube relative to the layers of the first section and the sections of each mixer element are polymorphically structured.

These and other objects of the invention will become more apparent from the following detailed description taken in conjunction with the accompanying drawings wherein:

FIG. 1 illustrates a perspective view of the baffles of a mixer with a polymorphic structure which is a "two stage multi-scale mixer";

FIG. 2 schematically illustrates a two stage multi-scale mixer in accordance with the invention;

Figure 5:
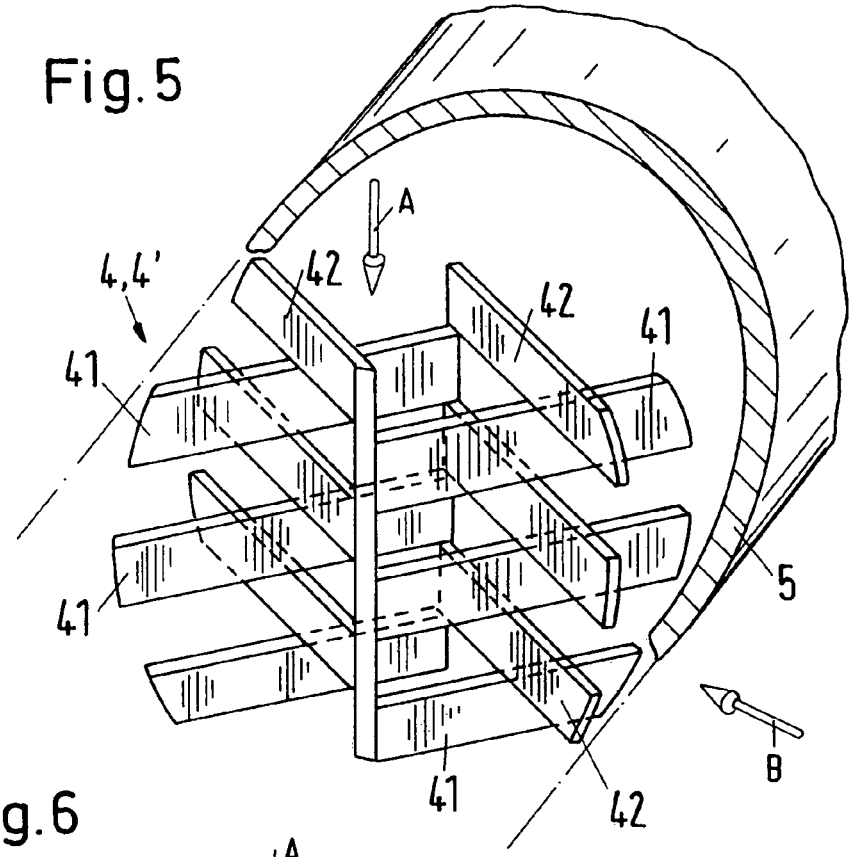
FIG. 5 illustrates the half portion of a known mixer element that has an "SMX structure"
Figure 6:
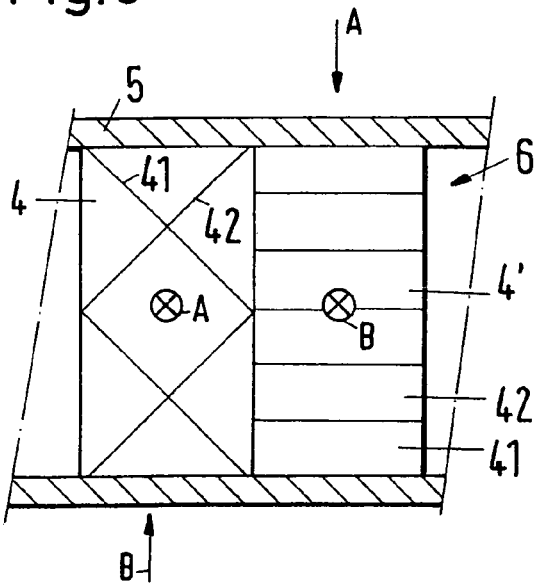
Figure 7:
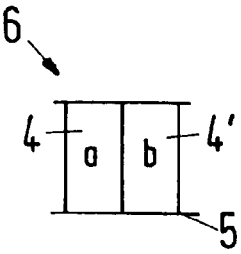
Figure 8:
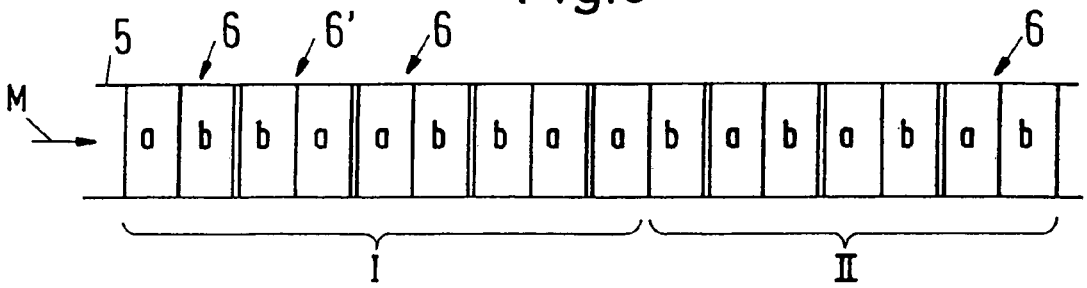

FIG. 6 schematically illustrates a mixer element formed of two of the elements that are shown in FIG. 5 in accordance with the invention;

FIG. 7 illustrates a symbolic representation of the mixer element of FIG. 6; and FIG. 8 schematically illustrates a mixer in accordance with the invention which is put together from the mixer elements in accordance with FIG. 6 and which forms a two stage uniscale mixer.

Figure 1:
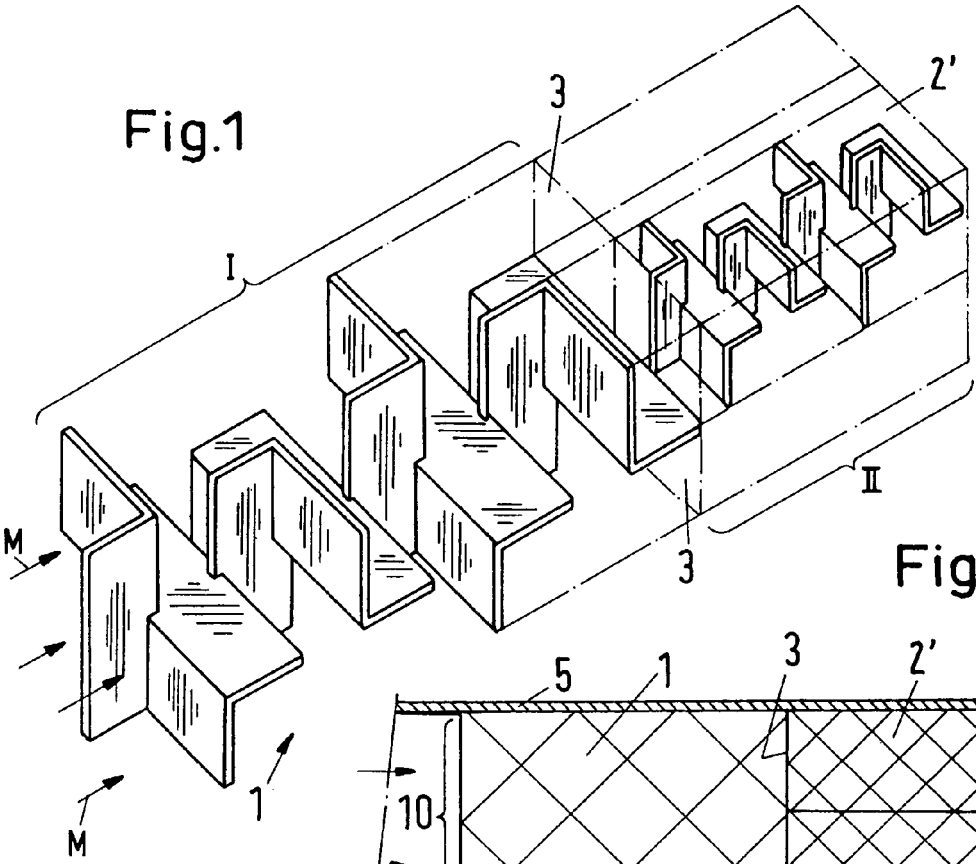

FIG. 1 shows inbuilt members (baffles) of a mixer which are effective to promote mixing, the mixer having a polymorphic structure such as that of the named U.S. Pat. No. 5,605,399. The baffles of which are however completely differently structured. The inbuilt members of this "two stage multi-scale mixer" are composed of two sections I and II.

The first section I consists of baffles 1, the structure of which is known from EPA-0 815 929. In this structure, four sequences of mixing chambers which are arranged next to one another form a communicating system. The baffles 1 are inserted into a non-illustrated tube 5 (see FIGS. 2 and 5). The flow of the medium to be mixed, which comprises at least two fluid components, flows in the longitudinal direction of the tube 5 and is indicated by arrows M.

The second section II, which is arranged downstream after the first section 1, consists of four baffles 2' which lie next to one another and which in each case have the shape of the chamber structure of the first section I reduced in scale by the factor 0.5. The cross-section of the tube 5 is subdivided into four partial surfaces 3 by the baffles 2'.

Figure 2:
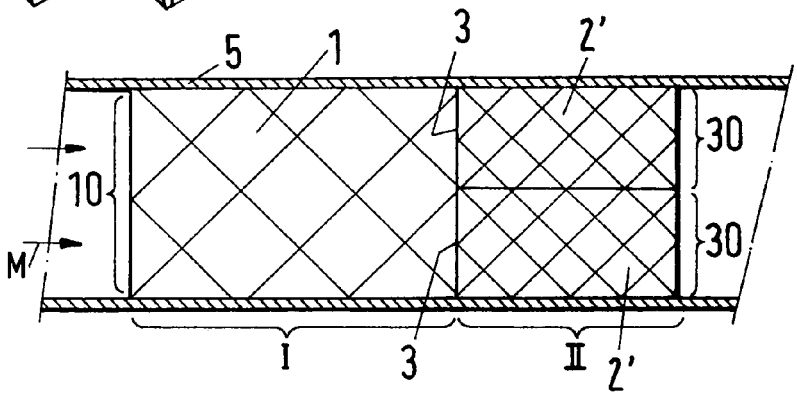

A mixer with a polymorphic structure is very schematically illustrated in FIG. 2. The mixer has a tube 5 that contains, for example, the baffles 1 and 2' of FIG. 1. Other baffles can also be used which yield a mixer with polymorphic structure. In particular uniscalar baffles in accordance with the invention can be used, which have structures with the same or approximately equally large hydraulic diameters.

In the first section I, in a partial region 10 of the mixer structure, the medium to be mixed is redistributed over the entire cross-section of the tube 5 by the baffles 1. In this region 10, a partial homogenization of the takes place.

At the end of the first section I and the beginning of the second section II, the cross-section of the tube is subdivided into partial surfaces 3. With respect to these partial surfaces 3, in an ideal case, the medium which is passing through has in each case quantity ratios of its components which are the same. In practice, this ideal case can not be realized. The length of the first section I can be dimensioned in such a manner that the quantity ratios differ at most by a predetermined percentage, for example 5, 10 or 20 percent. In the second section II, the baffles 2 are structured in such a manner that further homogenization can be effected with them, in each case, in longitudinal partial regions 30 following the partial surfaces 3. Here a longitudinal partial region 30 is to be understood to mean a cylindrical or prismatic region of the baffles 2 which extends in the longitudinal direction, i.e. in the direction of the tube 5 over the length of the second section II and the base surface of which is given by one of the partial surfaces 3.

Figure 3:
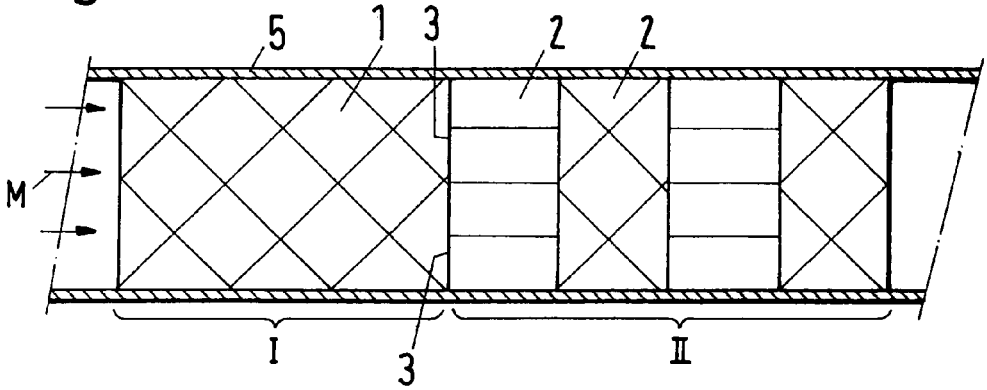
FIG. 3 illustrates a mixer in accordance with the invention in a schematic representation.

FIG. 3 shows in a schematic representation a mixer in accordance with the invention (uniscale mixer) in which the baffles of the second section II which are effective to promote mixing comprise a plurality of longitudinally arranged elements 2. The elements 2 are relatively short and effect as a result of their restricted length only local mixings in partial regions, which in each case contain only a part of the tube cross-section, i.e. one of the partial surfaces 3. Since it is not a dispersive mixing but rather a distributive mixing which is to be carried out, the baffles of both sections I, II have structures with the same or approximately equally large hydraulic diameters. A uniscalar structuring of this kind is associated with a pressure drop which is lower than with multiscalar structuring. The elements 2 of the second section II have in each case an anisotropic construction with layers that extend in the longitudinal direction. The layers of neighboring elements 2 are dissimilarly oriented (transverse to one another). A redistribution of the medium M is also largely restricted to longitudinal partial regions 30 (cf. FIG. 2) in the mixer in accordance with the invention. A transversal exchange between the partial regions 30 is however not prevented.

Both global and local mixing processes are important with regard to an ideal mixing quality. In the first section I of the mixer, the global mixing processes are foremost; in the second section II, the local mixing processes are foremost. The technique of having the global and local mixing processes principally take place in different zones of the polymorphic mixer structure proves to be advantageous. In comparison with a monomorphic mixer, a desired mixing quality is obtained over a shorter distance of the baffles which are effective to promote mixing.

Figure 4:
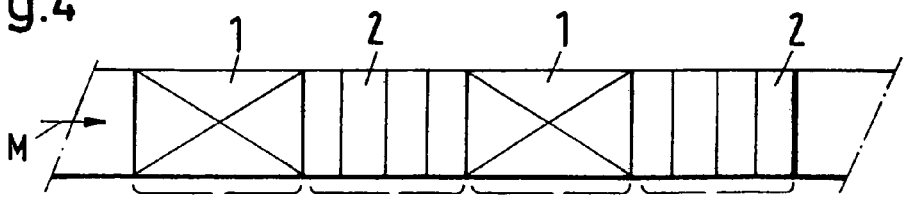
FIG. 4 illustrates a mixer with two similar regions arranged one after the other in accordance with the invention.

When mixing fluid components that can, for example, have very different viscosities, it can be advantageous for the global and local mixing processes to take place at the same time as far as possible. In this case, the solution in accordance with FIG. 4 is recommended. That is, the static mixer is constructed so that downstream of a region with a first section I with baffles 1 and a second section II with elements 2, there follows a further region which is formed in the same manner and likewise has a first section I' with baffles 1 and a second section II' with elements 2.

The baffles 1 can for example consist of mixer elements which form an "SMX structure" (see e.g. CH-A-642 564) or an "SMV structure". These structures have in each case a construction with layers which contain inclined flow passages and which are oriented in the longitudinal direction, with the flow passages of neighboring layers crossing one another. The "SMX structure" is constructed of two groups of parallel oriented webs which are crossed or staggered with respect to one another in such a manner that the webs cross. In the "SMV structure", the layers are formed by corrugated walls. The flow passages in the first section I effect a transport of the medium between points within the whole tube 5; in the second and each successive section II, the flow passages in each case bring about a transport of the medium which is largely restricted to the longitudinal partial regions 30. This restriction is present in the second section II in the longitudinal partial regions 30 because the length of the mixer elements is shortened. The restriction can however also result from the angle of inclination of the flow passages being made smaller.

FIG. 5 shows an element 4 (or 4') which forms a half part of the known mixer element with "SMX structure". This element 4 is inserted into a cylindrical tube 5. If one looks downwards from above onto the element 4, namely in the direction of the arrow A, one sees webs 41 and 42 from the side and one sees how the webs 41, 42 cross one another. If one looks from the side—in the direction of the arrow B—at the element 4, one looks onto the broad surfaces of the webs 41, 42, which now appear as strips lying in parallel. If one rotates the element 4 by 90°, so that the arrow B comes to lie on the position of the arrow A then the element 4 assumes a position in which the reference symbol 4' is assigned to it.

As shown in FIG. 5, each element 4 (or 4') includes a plurality of first webs 41 laying in a first plane to form a first web group, a plurality of second webs 42 laying in a second plane forming a second web group. The second plane intersects with the first plane along a first intersecting line perpendicular to the axis of the tube 5 with the first web group and the second web group extending from this first intersecting line to the peripheral wall of the tube 5. The webs 41,42 are disposed in alternating manner along the first intersecting line. Also, as shown, each element 4 (or 4') includes a plurality of third webs 41 laying in a third plane to form a third web group, a plurality of fourth webs 42 laying in a fourth plane fanning a fourth web group with the fourth plane intersecting with the third plane along a second intersecting line perpendicular to the axis of the tube 5 and longitudinally spaced from the first intersecting line with the third web group and the fourth web group extending from this second intersecting line to the peripheral wall of the tube 5. The third webs 41 and fourth webs 42 are disposed in alternating manner along the second intersecting line.

As shown, the webs 41 of the first web group cross the webs 41 of the third web group and the webs 42 of the second web group cross the webs 42 of the fourth web group to promote only local mixing of the fluid medium passing therethrough.

By putting the element 4 together with the element 4', one obtains an element 6, which is illustrated in simplified form in FIG. 6. In this FIG. 6, the respective positions of the arrows A and B which correspond to the two halves are indicated. The mixer elements 6 can be formed monolithically; they can in particular be cast parts which are manufactured by means of precision casting.

FIG. 7 shows a symbolic representation of the mixer element 6 of FIG. 6. The two halves are designated by a and b; they correspond to the left and right sides 4, 4' of the element 6 in FIG. 6 respectively. The following holds for a mixer element 6 in a generalized manner: The layers which are formed by the webs 41 and 42 are oriented in the first half a displaced with respect to the layers in the second half b by an angle, preferably by 90°; and the flow passages extend in the elements 6 over half the cross-section of the tube 5 at most.

A two stage mixer can be put together from the mixer elements 6, with it thus being possible for a polymorphic mixer to be manufactured with the single mixer structure of the mixer element 6. This is shown in FIG. 8 wherein in the first section I, elements 6, 6' are arranged and oriented in an alternating manner in such a way that the flow passages in the second half b of a first element 6 are oriented the same as the flow passages in the first half b of a following element 6'. Thus, the two equal halves a and b form in each case a pair respectively which corresponds to a complete SMX element. In SMX elements of this kind, a redistribution of the components to be mixed takes place over the entire tube cross-section (global mixing process). In the second section II, the elements 6 are all arranged the same, so that alternating halves a and b follow one another. Since the flow passages of the halves a and b respectively are in each case restricted to half a tube cross-section, local mixing processes largely take place, which occur in longitudinal partial regions. The number of these partial regions, which are all equally large, is four. It should also be noted that in the first section I, the first half a of the first element 6 does not yet contribute to a mixing of the medium over the entire tube cross-section.

The longitudinal partial regions 30 advantageously have cross-sectional surfaces which are largely isodiametral. In the case of a circular cross-section, the partial surfaces 3 in the second section II are four equally large sectors; in further sections the partial surfaces 3 are sectors or rectangular circle sections which have an expanse in the radial direction which is approximately equally as large in the tangential direction, which is perpendicular to the radial direction.

In the use of baffles 1, 2 in accordance with FIG. 1 or of similar baffles, the tube cross-section is rectangular, in particular square. The cross-sections of the longitudinal partial regions are likewise rectangular.

In the described examples the sections I, II are in each case monomorphic. It is however also possible for the sections themselves to be structured polymorphically.

What is claimed is:

1. A static mixer with a polymorphic structure for mixing a fluid medium, said static mixer comprising a tube for passage of a fluid medium to be mixed;

at least two sections arranged in a first portion of said tube in sequential manner in a longitudinal direction of said tube;

a plurality of first baffles within a first section of said two sections and extending across said first section to promote mixing and to redistribute the fluid medium largely globally over the entire cross-section of said tube;

a plurality of second baffles within a second section of said two sections, each said second baffle extending over only a partial region of a plurality of partial regions of said second section to promote mixing and to effect largely only local mixing in each respective partial region; and said baffles of said first section and said baffles of said second section having the same or approximately equally large hydraulic diameters.

2. A static mixer as set forth in claim 1 characterized in that said baffles of said second section include a plurality of longitudinally arranged elements for effecting local mixing in each respective partial region as a result of a restricted length, each said element of said second section having an anisotropic construction of layers extending in said longitudinal direction with the layers of neighboring elements being differently oriented.

3. A static mixer as set forth in claim 2 wherein at least each said element of said second section is formed monolithically.

4. A static mixer as set forth in claim 3 wherein each said element of said second section is a precision casting.

5. A static mixer as set forth in claim 3 characterized in that at least two neighboring elements in at least one of said sections form a monolithic block.

6. A static mixer as set forth in any one of claims 1 to 5 wherein said baffles of said second section subdivide the cross-section of said tube into at least two partial regions extending longitudinally from said first section whereby said baffles in said first section effect a partial homogenization of a medium passing therethrough and said baffles of said second section effect further homogenization of each portion of the medium passing through a respective longitudinally extending partial region.

7. A static mixer as set forth in claim 1 wherein said baffles of said first section define layers of inclined flow passages oriented in said longitudinal direction to effect a transport of the medium between points within said tube with said flow passages of neighboring layers disposed in crossing relation to each other; and wherein said baffles of said second section define layers of inclined flow passages oriented in said longitudinal direction to effect a transport of the medium between points within each respective longitudinally extending partial region and wherein said flow passages of neighboring layers are disposed in crossing relation to each other.

8. A static mixer as set forth in claim 1 wherein said tube has a plurality of said portions disposed longitudinally thereof, each said portion having a first section including a plurality of baffles effective to promote mixing and to redistribute the fluid medium largely globally over the entire cross-section of said tube and a second section including a plurality of baffles effective to promote mixing and to effect largely local mixing in partial regions, each said partial region containing only one part of said cross-section of said tube.

9. A static mixer as set forth in claim 8 wherein said second section of one of said portions of said tube is disposed adjacent to said second section of an adjacent portion of said tube.

10. A static mixer as set forth in claim 8 wherein said first and second sections of said portions of said tube are disposed in alternating relation.

11. A static mixer with a polymorphic structure for mixing a fluid medium, said static mixer comprising a tube having a peripheral wall defining a passage of a fluid medium to be mixed;

a plurality of elements disposed in said tube in sequential manner longitudinally of an axis of said tube, each said element including a plurality of first webs laying in a first plane to form a first web group, a plurality of second webs laying in a second plane forming a second web group, said second plane intersecting with said first plane along a first intersecting line perpendicular to said axis of said tube with said first web group and said second web group extending from said first intersecting line to said peripheral wall of said tube, said first webs and said second webs being disposed in alternating manner along said first intersecting line, a plurality of third webs laying in a third plane to form a third web group, a plurality of fourth webs laying in a fourth plane forming a fourth web group, said fourth plane intersecting with said third plane along a second intersecting line perpendicular to said axis of said tube and longitudinally spaced from said first intersecting line with said third web group and said fourth web group extending from said second intersecting line to said peripheral wall of said tube, said third webs and said fourth webs being disposed in alternating manner along said second intersecting line, said webs of said first web group crossing said webs of said third web group and said webs of said second web group crossing said webs of said fourth web group to promote only local mixing of the fluid medium passing therethrough;

said elements being disposed in said tube in a selected one of two orientations (a,b) relative to an adjacent element wherein one (a) of said two orientations is rotated 90° relative to the other (b) of said two orientations and said elements are disposed in a repeating sequence of a, b, b, a in a first section of said tube to promote global mixing of the fluid medium in said first section and a repeating sequence of a, b in a longitudinally following second section of said tube to promote only local mixing of the fluid medium in said second section.

* * * * *

UNITED STATES PATENT AND TRADEMARK OFFICE

CERTIFICATE OF CORRECTION

PATENT NO. : 7,438,464 B2
APPLICATION NO. : 10/903273
DATED : October 21, 2008
INVENTOR(S) : Felix Moser et al.

It is certified that error appears in the above-identified patent and that said Letters Patent is hereby corrected as shown below:

Title page,

Item "(73) Assignee: Sulzar Chemtech AG, Winterthur (CH)"

should be

-- (73) Assignee: Sulzer Chemtech AG, Winterthur (CH) -- column 4, line 62, "fanning" should be -- forming --

Signed and Sealed this

Twentieth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 7,438,464 B2
APPLICATION NO. : 10/903273
DATED : October 21, 2008
INVENTOR(S) : Felix Moser et al.

It is certified that error appears in the above-identified patent and that said Letters Patent is hereby corrected as shown below:

On the Title Page

Item "(73) Assignee: Sulzar Chemtech AG, Winterthur (CH)"

should be

Item -- (73) Assignee: Sulzer Chemtech AG, Winterthur (CH) -- column 4, line 62, "fanning" should be -- forming --

Signed and Sealed this

Third Day of February, 2009

John Doll

JOHN DOLL
*Acting Director of the United States Patent and Trademark Office*